US008326198B2

(12) United States Patent
Barton et al.

(10) Patent No.: US 8,326,198 B2
(45) Date of Patent: Dec. 4, 2012

(54) APPARATUSES USEFUL IN PRINTING, FIXING DEVICES AND METHODS OF PREHEATING SUBSTRATES IN APPARATUSES USEFUL IN PRINTING

(75) Inventors: Augusto E. Barton, Webster, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 454 days.

(21) Appl. No.: 12/606,301

(22) Filed: Oct. 27, 2009

(65) Prior Publication Data

US 2011/0094440 A1 Apr. 28, 2011

(51) Int. Cl.
*G03G 15/20* (2006.01)
*F25B 29/00* (2006.01)

(52) U.S. Cl. ..... 399/328; 165/61

(58) Field of Classification Search ..... 399/328, 399/329, 330, 122, 33, 92, 61; 165/61, 80.2, 165/80.3

See application file for complete search history.

(56) References Cited

U.S. PATENT DOCUMENTS 5,463,454 A * 10/1995 Yasuda et al. ..... 430/123.5
5,476,568 A * 12/1995 Marion et al. ..... 156/359
5,614,933 A 3/1997 Hindman et al.
2003/0053818 A1* 3/2003 Kimura ..... 399/94
2003/0206757 A1* 11/2003 Ishikawa et al. ..... 399/329
2008/0037069 A1 2/2008 Mestha et al.
2008/0240768 A1* 10/2008 Segawa et al. ..... 399/92
2009/0257773 A1 10/2009 Barton et al.

FOREIGN PATENT DOCUMENTS

JP 08262894 A * 10/1996
JP 2000338803 A * 12/2000

OTHER PUBLICATIONS

James Edward Williams; U.S. Appl. No. 12/197,492, filed Aug. 25, 2008.

* cited by examiner

*Primary Examiner* — Walter L Lindsay, Jr.
*Assistant Examiner* — Billy J Lactaoen
(74) *Attorney, Agent, or Firm* — Ronald E. Prass, Jr.; Prass LLP

(57) ABSTRACT

Apparatuses useful in printing, fixing devices and methods of preheating substrates in apparatuses useful in printing are provided. An exemplary embodiment of the apparatuses useful in printing includes a first member including a first surface; a second member including a second surface forming a nip with the first surface; a substrate cooler disposed downstream from the nip to receive a first substrate exiting the nip, the substrate cooler removing heat from the first substrate by conduction; a substrate pre-heater disposed upstream from the nip; and a first heat transfer system for transferring heat from the substrate cooler to the substrate pre-heater. The substrate pre-heater applies the heat to conductively pre-heat a second substrate before the second substrate enters the nip.

16 Claims, 3 Drawing Sheets

APPARATUSES USEFUL IN PRINTING, FIXING DEVICES AND METHODS OF PREHEATING SUBSTRATES IN APPARATUSES USEFUL IN PRINTING

BACKGROUND

In printing apparatuses, images are formed on substrates using marking materials. Such printing apparatuses can include opposed members that form a nip. Substrates are fed to the nip and subjected to processing conditions to fix the marking material onto the substrates. Heat can be applied at the nip.

It would be desirable to provide apparatuses useful in printing, fixing devices and methods of preheating substrates in apparatuses useful in printing that can use recovered heat.

SUMMARY

Apparatuses useful in printing, fixing devices and methods of preheating substrates in apparatuses useful in printing are provided. An exemplary embodiment of the apparatuses useful in printing comprises a first member including a first surface; a second member including a second surface forming a nip with the first surface; a substrate cooler disposed downstream from the nip to receive a first substrate exiting the nip, the substrate cooler removing heat from the first substrate by conduction; a substrate pre-heater disposed upstream from the nip; and a first heat transfer system for transferring heat from the substrate cooler to the substrate pre-heater. The substrate pre-heater applies the heat to conductively pre-heat a second substrate before the second substrate enters the nip.

DETAILED DESCRIPTION

The disclosed embodiments include apparatuses useful in printing. An exemplary embodiment of the apparatuses comprises a first member including a first surface; a second member including a second surface forming a nip with the first surface; a substrate cooler disposed downstream from the nip to receive a first substrate exiting the nip, the substrate cooler removing heat from the first substrate by conduction; a substrate pre-heater disposed upstream from the nip; and a first heat transfer system for transferring heat from the substrate cooler to the substrate pre-heater. The substrate pre-heater applies the heat to conductively pre-heat a second substrate before the second substrate enters the nip.

The disclosed embodiments further include fixing devices. An exemplary embodiment of the fixing devices comprises a first member including a first surface; a second member including a second surface forming a nip with the first surface; a substrate cooler disposed downstream from the nip to receive a first substrate exiting the nip, the substrate cooler removing heat from the first substrate by conduction; a substrate pre-heater disposed upstream from the nip; and a first heat transfer system for transferring heat from the substrate cooler to the substrate pre-heater. The substrate pre-heater applies the heat to conductively pre-heat a second substrate before the second substrate enters the nip.

The disclosed embodiments further include methods of preheating substrates in apparatuses useful in printing. An exemplary embodiment of the methods comprises pre-heating substrates in an apparatus useful in printing comprising a first member including a first surface and a second member including a second surface forming a nip with the first surface. The method comprises removing heat from the first substrate by conduction in a substrate cooler disposed downstream from the nip; transferring heat from the substrate cooler to a substrate pre-heater disposed upstream from the nip with a first heat transfer system; and applying the transferred heat to conductively pre-heat a second substrate at the substrate pre-heater before the second substrate enters the nip.

Figure 1:
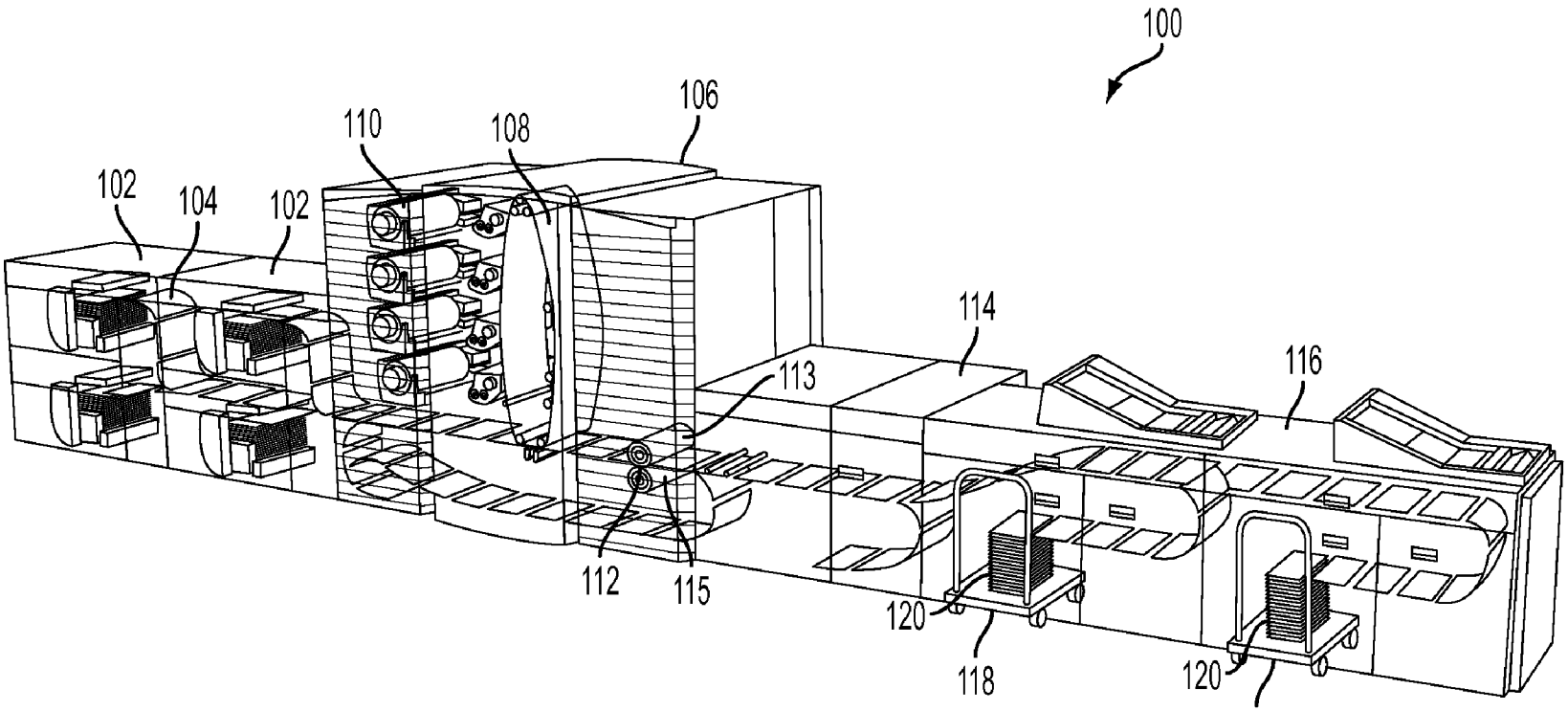
FIG. 1 illustrates an embodiment of a printing apparatus.

Embodiments of the apparatuses useful in printing may include a printing apparatus, such as shown in FIG. 1; a portion of a printing apparatus, such as a fixing device; or another type of apparatus that forms images on substrates, such as copiers, facsimile machines, multi-function machines, and the like, or portions thereof.

The apparatuses useful in printing can use various types of solid and liquid marking materials, including toners and inks (e.g., liquid inks, gel inks, heat-curable inks and radiation-curable inks), and the like. The apparatuses can apply various thermal, pressure and other process conditions to treat marking materials on substrates.

FIG. 1 illustrates an exemplary printing apparatus 100 disclosed in U.S. Patent Application Publication No. 2008/0037069, which is incorporated herein by reference in its entirety. The printing apparatus 100 includes two substrate feeder modules 102 arranged in series, a printer module 106 adjacent the substrate feeder modules 102, an inverter module 114 adjacent the printer module 106, and two stacker modules 116 arranged in series adjacent the inverter module 114. In the printing apparatus 100, the substrate feeder modules 102 feed substrates to the printer module 106. In the printer module 106, marking material (toner) is transferred from a series of developer stations 110 to a charged photoreceptor belt 108 to form toner images on the photoreceptor belt 108 and produce prints. The toner images are transferred to respective substrates 104 fed through the paper path. The substrates 104 are advanced through a fuser 112 including a fuser roll 113 and a pressure roll 115, which form a nip where heat and pressure are applied to the substrates 104 to fuse toner images onto the substrates. The inverter module 114 manipulates substrates 104 exiting the printer module 106 by either passing the substrates through to the stacker modules 116, or inverting and returning the substrates to the printer module 106. In the stacker modules 116, the printed substrates are loaded onto stacker carts 118 to form stacks 120.

It has been noted that during fixing of marking materials (toner) onto substrates by the use of applied pressure and heat (thermal energy) in contact fusers, significant energy losses occur and only a small percentage of the total energy applied by the fusers heats the toner. For example, less than about 6% of the total energy may heat the toner. It has further been noted that a significant percentage of the total energy (e.g., >60%) can go to heating the substrate. Energy losses can be about 33% or more in such apparatuses. Moreover, even if the energy losses could be reduced to zero in such apparatuses, at least about 90% of the energy would still go to heating the substrate.

In view of such energy losses in contact fusers, apparatuses useful in printing, fixing devices and methods of preheating substrates in apparatuses useful in printing are provided that provide improved energy efficiency by recovering thermal energy from heated substrates that have been heated at a nip (e.g., fused prints) and applying the recovered thermal energy to pre-heat subsequent substrates (e.g., unfused prints) before they enter the nip.

Figure 2:
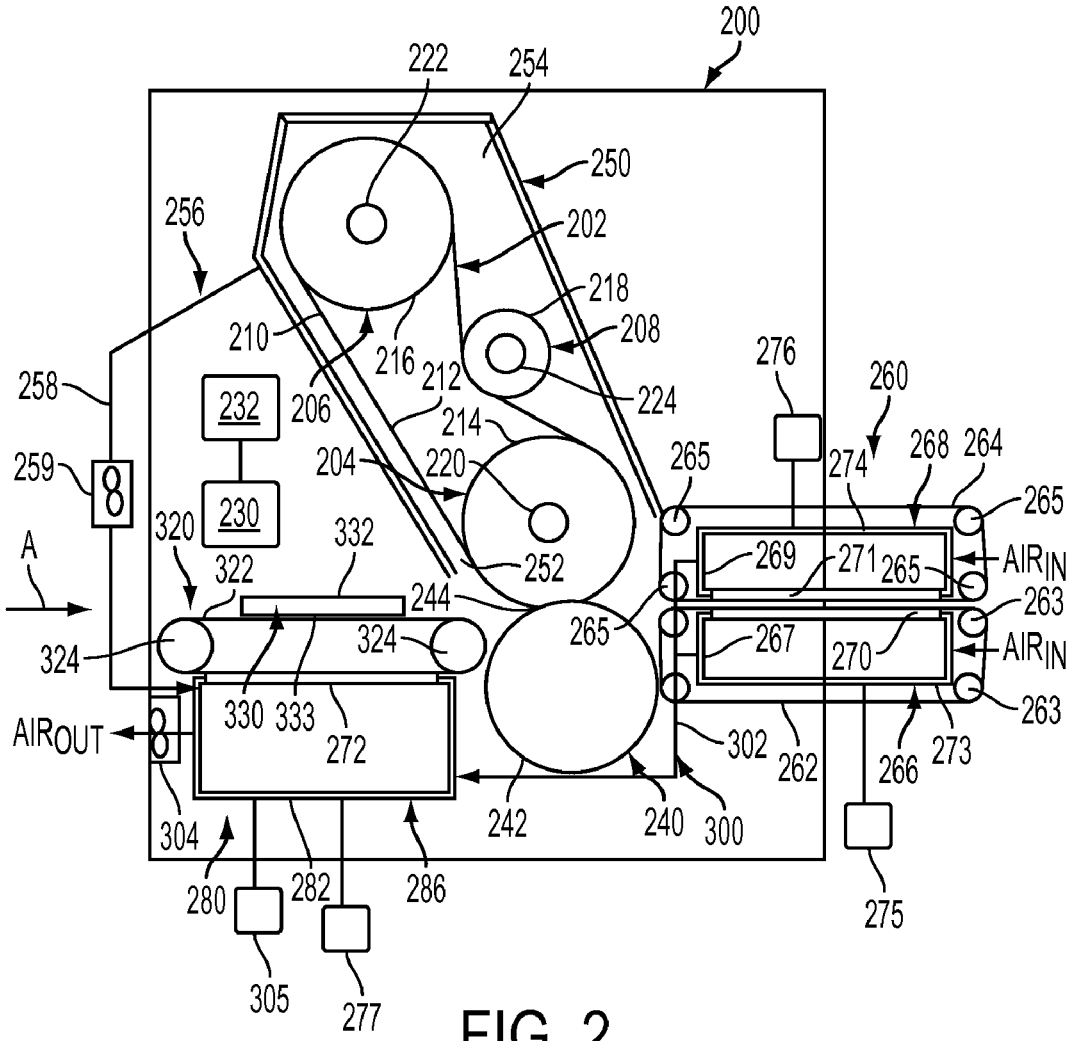
FIG. 2 illustrates an embodiment of a fixing device including a belt and a substrate pre-heater.

Embodiments of the apparatuses useful in printing can include a fixing device. FIG. 2 illustrates an exemplary embodiment of a fuser 200 constructed to fix marking materials onto substrates. Embodiments of the fuser 200 can be provided in different types of printing apparatuses. For example, the fuser 200 can be used in place of the fuser 112 in the printing apparatus 100 shown in FIG. 1.

As shown in FIG. 2, the fuser 200 includes a continuous fuser belt 202 provided on a fuser roll 204, an internal roll 206 and an external roll 208. The fuser belt 202 has an outer surface 210 and an inner surface 212.

The fuser roll 202, internal roll 206 and external roll 208 have outer surfaces 214, 216 and 218, respectively, contacting the fuser belt 202. The fuser roll 204, internal roll 206 and external roll 208 include internal heating elements 220, 222 and 224, respectively. The heating elements 220, 222 and 224 can be, e.g., one or more axially-extending lamps. The heating elements are connected to a power supply 230 in a conventional manner. The power supply 230 is connected to a controller 232 in a conventional manner. The controller 232 controls the supply of voltage to the heating elements 220, 222 and 224, to heat the fuser belt 202 to the desired temperature.

The fuser 200 further includes an external pressure roll 240 having an outer surface 242. The outer surface 242 is shown engaging the outer surface 210 of the fuser belt 202 to form a nip 244. The outer surface 214 of the fuser roll 204 is shown as being indented by contact with the pressure roll 240. In other embodiments, the outer surface 242 of the pressure roll 240 can be softer than the outer surface 214 of the fuser roll 204, resulting in the outer surface 242 being indented by contact with the fuser roll 204.

Embodiments of the fuser belt 202 can include two or more layers. For example, the fuser belt 202 can include a base layer forming the inner surface 212, an intermediate layer, and an outer layer forming the outer surface 210. In an exemplary embodiment, the base layer can be comprised of a polymer, such as polyimide, or the like; the intermediate layer of an elastomer, such as silicone, or the like; and the outer layer of a polymer, such as a fluoroelastomer sold under the trademark Viton® by DuPont Performance Elastomers, L.L.C., polytetrafluoroethylene, or the like.

In embodiments, the fuser belt 202 can have a thickness of about 0.1 mm to about 0.5 mm, such as less than about 0.2 mm. The fuser belt 202 can typically have a width dimension along the axial direction of the fuser roll 204 of about 350 mm to about 450 mm.

As shown in FIG. 2, the fuser 200 further includes a thermally-insulated enclosure 250. The enclosure 250 includes an open end 252 and an interior space 254. The enclosure 250 is constructed to confine heat emanated by the fuser belt 202 and other components enclosed by the enclosure 250, inside of the enclosure 250. The enclosure 250 is configured to surround a substantial portion of the fuser belt 202 and fuser roll 204.

The enclosure 250 is thermally insulated. For example, the enclosure 250 can comprise at least one ceramic, polymeric or composite material with suitable thermal insulator properties. The enclosure 250 can be mounted in the apparatus in any suitable manner, such as by attachment to the mainframe.

Heat confined within the enclosure 250 can be recovered and used to pre-heat substrates prior to entering the nip 244. As shown, the enclosure 250 is connected to a substrate pre-heater 280 by a heat transfer system 256 including a flow passage 258 and a blower 259. The blower 259 draws heated air from the interior space 254 of the enclosure 250 into the substrate pre-heater 280. By increasing the heat confinement efficiency of the enclosure 250, a greater percentage of the heat emanated from the fuser belt 202 and other components can be recovered and used to pre-heat substrates. By using this pre-heating, the temperature to which the fuser belt 202 needs to be heated in order to effectively fix marking materials on substrates using the fuser belt 202 can be reduced as compared to not using this pre-heating. Consequently, the total amount of energy consumption by the fuser 200 can be reduced by using this pre-heating.

The fuser 200 further includes a substrate cooler 260 positioned downstream from the nip 244, the substrate pre-heater 280 positioned upstream from the nip 244, and a heat transfer system 300 connected to the substrate cooler 260 and the substrate pre-heater 280. The substrate cooler 260 is constructed to transfer heat from substrates that have been heated by passing through the nip 244 to air within the substrate cooler 260. This heat transfers occurs as the substrates pass through the substrate cooler 260. The recovered heat from the substrates heats the air, which is flowed from the substrate cooler 260 to the substrate pre-heater 280 via the heat transfer system 300. At the substrate pre-heater 280, the heated air is applied to pre-heat incoming substrates before they enter the nip 244.

In the illustrated embodiment, the substrate cooler 260 includes a first heat transfer belt 262 supported on rolls 263 and a second heat transfer belt 264 supported on rolls 265. In the illustrated orientation of the fuser 200, the first heat transfer belt 262 contacts the bottom surface, and the second heat transfer belt 264 contacts the top surface (imaged surface), of substrates received in the substrate cooler 260. In embodiments, the first heat transfer belt 262 and second heat transfer belt 264 can be wide (e.g., wider than the substrates in the direction perpendicular to process direction A) to provide a large surface area for heat transfer by conduction from the substrates. The first heat transfer belt 262 and the second heat transfer belt 264 are comprised of a material having suitable thermal conductivity, such as polyamide, or the like.

The substrate cooler 260 also includes a first heat sink 266 located internally of the first heat transfer belt 262 and a second heat sink 268 located internally of the second heat transfer belt 264. The first heat sink 266 includes a first heat transfer member 270 that contacts the bottom surface, and the second heat sink 268 includes a second heat transfer member 271 that contacts the top surface, of substrates. The first heat transfer member 270 and the second heat transfer member 271 can be metal plates, for example.

During operation of the fuser 200, the first heat sink 266 cools the first heat transfer belt 262 and the second heat sink 268 cools the second heat transfer belt 264. The first heat sink 266 includes a plurality of fins (not shown) inside of a housing 273 and the second heat sink 268 includes a plurality of fins (not shown) inside of a housing 274. The fins have a length dimension extending parallel to both the process direction A and an air flow direction through the substrate cooler 260. The fins extend parallel to each other. In an exemplary embodiment, the individual fins can have a length (along process direction A) of about 300 mm to about 700 mm, a thickness of about 1 mm to about 2 mm, and a height of about 300 mm to about 400 mm. The fins can be spaced from each other perpendicular to the process direction A by a distance of about 2 mm to about 3 mm. The fins can be comprised of any suitable thermally-conductive material, such as aluminum, or the like. The number and size of the fins in the first heat sink 266 and second heat sink 268 can be selected to provide a high effective surface area for convective heat transfer to air in the substrate cooler 260.

In the fuser 200, an air flow is produced to cool the first heat sink 266 and second heat sink 268 to provide a temperature differential between the substrates passing through the substrate cooler 260 and the air. Ambient air can be used as the air source. Air is drawn into the first heat sink 266 and second heat sink 268 and forced through the fins. The air flow is opposite to the process direction A to increase the heat transfer efficiency. Heat is transferred by convection from the fins to the air, heating the air to an elevated temperature.

The dwell time of substrates in the substrate cooler 260 can be adjusted to ensure that substrates are within the substrate cooler 260 for at least a sufficient length of time to remove a sufficient amount of thermal energy from the substrates to cool the substrates to the desired temperature.

The heat transfer system 300 includes an air-circulating system for circulating hot air from the substrate cooler 260 to the substrate pre-heater 280. The heat transfer system 300 includes a flow passage 302 in flow communication with the first heat sink 266 and the second heat sink 268 and a blower 304. The blower 304 produces an air flow by drawing air ($Air_{in}$) into the first heat sink 266 and second heat sink 268, through the flow passage 302 and through the substrate pre-heater 280 ($Air_{out}$). In an exemplary embodiment, the air flow rate can be from about 0.006 $m^3/s$ to about 0.010 $m^3/s$. As shown, the flow passage 302 is connected to the end 267 of the first heat sink 266 and the end 269 of the second heat sink 268 closest to the nip 244 to allow the air to flow along the entire lengths of the fins to maximize heat transfer to the air. The flow passage 302 is thermally insulated to reduce cooling of the heated air between the substrate cooler 260 and the substrate pre-heater 280.

The air flow rate from the substrate cooler 260 to the substrate pre-heater 280 can be controlled (down to a flow rate of zero) to control the temperature of the fins and a heat transfer member 272 of the substrate pre-heater 280, to control pre-heating of substrates. A temperature sensor 305 can sense these temperatures and provide feedback to control operation of the blower 304 to control the air flow.

In the embodiment, a substrate transport device 320 conveys substrates to the nip 244. The substrate transport device 320 includes a rotatable conveyer belt 322 supported on rolls 324. A substrate 330 is shown being conveyed on the conveyer belt 322 toward the nip 244. The substrate 330 includes a top surface 332 and an opposite bottom surface 333. Marking material is applied on the top surface 332. The downstream end of the conveyer belt 322 closest to the nip 244 can typically be spaced about 25 mm to about 50 mm from the nip 244 to minimize cooling of pre-heated substrates before they reach the inlet end of the nip 244. The substrate pre-heater 280 directly heats the conveyer belt 322 by conduction. In the illustrated configuration, the substrate pre-heater 280 heats the bottom portion of the rotating conveyer belt 322 by conduction. Heat is conducted from the conveyer belt 322 to the bottom surface 333 of the substrate 330 supported on the top portion of the conveyer belt 322. Accordingly, the substrate pre-heater 280 indirectly pre-heats the substrate 330 before heat and pressure are applied to the marking material, e.g., toner, at the nip 244.

The transport speed of substrates on the conveyer belt 322 can be adjusted for different types of media, e.g., different weights of paper. For example, the transport speed can be higher for thinner substrates than for thicker media to supply the desired amount of thermal energy to the substrates.

The fuser roll 204 is rotated counter-clockwise and the pressure roll 240 is rotated clockwise to rotate the fuser belt 202 counter-clockwise and convey the substrate 330 through the nip 244.

In the embodiment, the substrate pre-heater 280 includes a housing 282, and a third heat sink 286. The third heat sink 286 is heated by the hot air circulated from the substrate cooler 260 via the flow passage 302. The housing 282 can be thermally insulated to reduce cooling of the hot air to allow the third heat sink 286 to be heated to a desirable temperature.

In embodiments, the third heat sink 286 includes a plurality of fins having a length dimension extending parallel to the process direction A. The fins extend parallel to each other. In an exemplary embodiment, the individual fins can have a length of about 300 mm to about 700 mm, a thickness of about 1 mm to about 2 mm, and a height of about 650 mm to about 750 mm. The third heat sink 286 can be larger than either of the first heat sink 266 and second heat sink 268 of the substrate cooler 260 because the substrate pre-heater 280 includes a single heat sink and un-fused media are typically only heated from the bottom surface. The fins can be comprised of any suitable thermally-conductive material, such as aluminum. The number and size of the fins in the third heat sink 286 are selected to provide a high effective surface area for convective heat transfer in the substrate pre-heater 280.

By increasing the effective surface area of the fins of the third heat sink 286, the amount of air flow of the heated air that is sufficient to heat the fins to a desired temperature can be decreased. In the third heat sink 286, fins are in thermal contact with the heating member 272, such as a metallic plate. The heating member can have a width as large as that of the conveyer belt 322 to allow the metallic plate to directly heat the entire width of the conveyer belt 322.

The heated air supplied to the substrate pre-heater 280 via the flow passage 302 provides heat to the substrate 330 being conveyed by the conveyer belt 322. The substrate 330 is heated primarily by conduction before the substrate 330 reaches the nip 244, where it is subjected to sufficient heat and pressure via the fuser belt 202 and pressure roll 240 to fix marking material onto the substrate 330.

In embodiments, heating devices 275, 276 and 277 are operatively associated with the first heat sink 266, second heat sink 268 and third heat sink 286, respectively, to allow these heat sinks to be heated to a desired temperature prior to feeding substrates to the nip 244.

By pre-heating substrates using the hot air distributed by the substrate pre-heater 280, the amount of additional heat that needs to be supplied to the substrates at the nip 244 via the fuser belt 202 (and optionally the pressure roll 240) to effect fixing of marking material onto the substrates can be reduced significantly as compared to not pre-heating the substrates prior to reaching the nip 244. The amount of additional heat applied to the substrates at the nip 244 by the fuser belt 202 is controlled by the fuser temperature set-point. As the amount of energy that needs to be applied to the fuser roll 204, internal roll 206 and external roll 208 to heat the fuser belt 202 to a sufficiently-high temperature to fix marking material onto the substrate 330 can be reduced in the fuser 200, the fuser temperature set-point can be reduced. Accordingly, using the substrate pre-heater 280 to pre-heat the substrates with recovered thermal energy heat from the substrate cooler 260 enhances the energy efficiency of the fuser 200.

It is desirable that the pre-heat temperature of the substrate 330 be below the glass transition temperature of marking material on substrates fed to the nip 244. For example, for a duplex (two-sided) printing process, it is desirable to limit the maximum temperature to which substrates are heated by the hot air typically to a temperature of less than 55° C., in order to avoid fused toner being subject to image quality (IQ) defects on the substrates. The pre-heat temperature of the substrates can be controlled by adjusting the flow of the hot air from the substrate cooler 260 to the substrate pre-heater 280.

The fuser 200 can be used for fixing marking materials on substrates having a range of thicknesses. The substrates can be, e.g., coated or uncoated paper sheets. Light-weight paper typically has a weight of ≦ about 75 gsm, substrate-weight paper a weight of about 75 gsm to about 160 gsm, and heavy-weight paper a weight of ≧160 gsm. During operation of a printing apparatus, a user may produce copies using substrates all of the same thickness, or from substrates with different thicknesses. For example, a user may make copies using substrates having a first thickness and then make copies from substrates having a greater second thickness. The amount of heat that needs to be supplied to thicker substrates to fix marking materials onto them generally is greater than the amount of heat that needs to be supplied to thinner substrates of the same material to fix the same marking materials onto the thinner sheets. In order to heat thicker sheets to a sufficiently-high temperature to treat marking materials on the sheets, the fuser typically heats the belt to a higher temperature than used for thinner sheets in order to supply an increased amount of heat to the thicker sheets to effect fixing of marking materials onto them.

The temperature of the fuser belt (i.e., the temperature set point) can be increased during operation of the fuser by increasing the amount of heat supplied to the fuser belt. Heating the fuser belt from one set point to a higher set point can cause a time delay in the printing process. To reduce this time delay, the apparatus can begin to increase the temperature set point of the fuser belt before thicker sheets are printed. This approach may result in thinner sheets being subjected to a higher fuser temperature set point than needed to fix marking material on these sheets.

Embodiments of the disclosed fusers, such as the fuser 200, can be used to fix marking materials onto both thinner and thicker substrates while maintaining a more uniform temperature set point of the fuser belt 202. For example, to treat marking material on thinner substrates using the fuser 200, the blower 304 and blower 259 can be turned OFF so that heat is not transferred by an air flow from the substrate cooler 260 or the enclosure 250 to the substrate pre-heater 280 and substrates are not pre-heated. The temperature set point of the fuser belt 202 can be selected to ensure that the fuser belt 202 supplies sufficient heat to the thinner substrates at the nip 244 to fix marking material onto these substrates. When thicker substrates are to be printed using the fuser 200, the blower 304 and/or blower 259 can be turned ON to transfer heated air to the substrate pre-heater 280 to pre-heat the thicker substrates so that the fuser belt 202 supplies sufficient additional heat to the substrates at the nip 244 to fix marking material onto the thicker substrates. The substrate pre-heater 280 can be used to heat the conveyer belt 322 to the desired temperature to pre-heat the thicker substrates more quickly than by heating the fuser belt 202 to a higher temperature set point. Accordingly, the fuser 200 can provide improved time and energy efficiency when used for printing thinner and thicker substrates in the same apparatus.

By removing heat from the substrates at the substrate cooler 250 and pre-heating substrates at the substrate pre-heater 280 both by conduction (i.e., by contact between belts and the substrates) instead of by convection (i.e., by flowing hot air over the substrates), the thermal efficiency of the cooling and pre-heating processes are significantly increased. Also, by using a third heat sink 286 with a large amount of convective heat transfer surface area, lower hot air temperatures and lower hot air flow rates can be used to heat the third heat sink 286 to a temperature effective to heat the substrates, as compared to convectively heating the substrates by a hot air flow.

In other exemplary embodiments of the fuser 200 shown in FIG. 2, heat can transferred from the substrate cooler 260 to the substrate pre-heater 280 by a combination of convection and thermal conduction, or substantially only by thermal conduction, by providing a thermally-conductive member, such as a metallic member in thermal communication with the substrate cooler 260 and substrate pre-heater 280. For example, the thermally-conductive member can connect heat transfer members that contact opposite surfaces of substrates in the substrate cooler 260 to a heat transfer member that contacts the conveyer belt 322.

Figure 3:
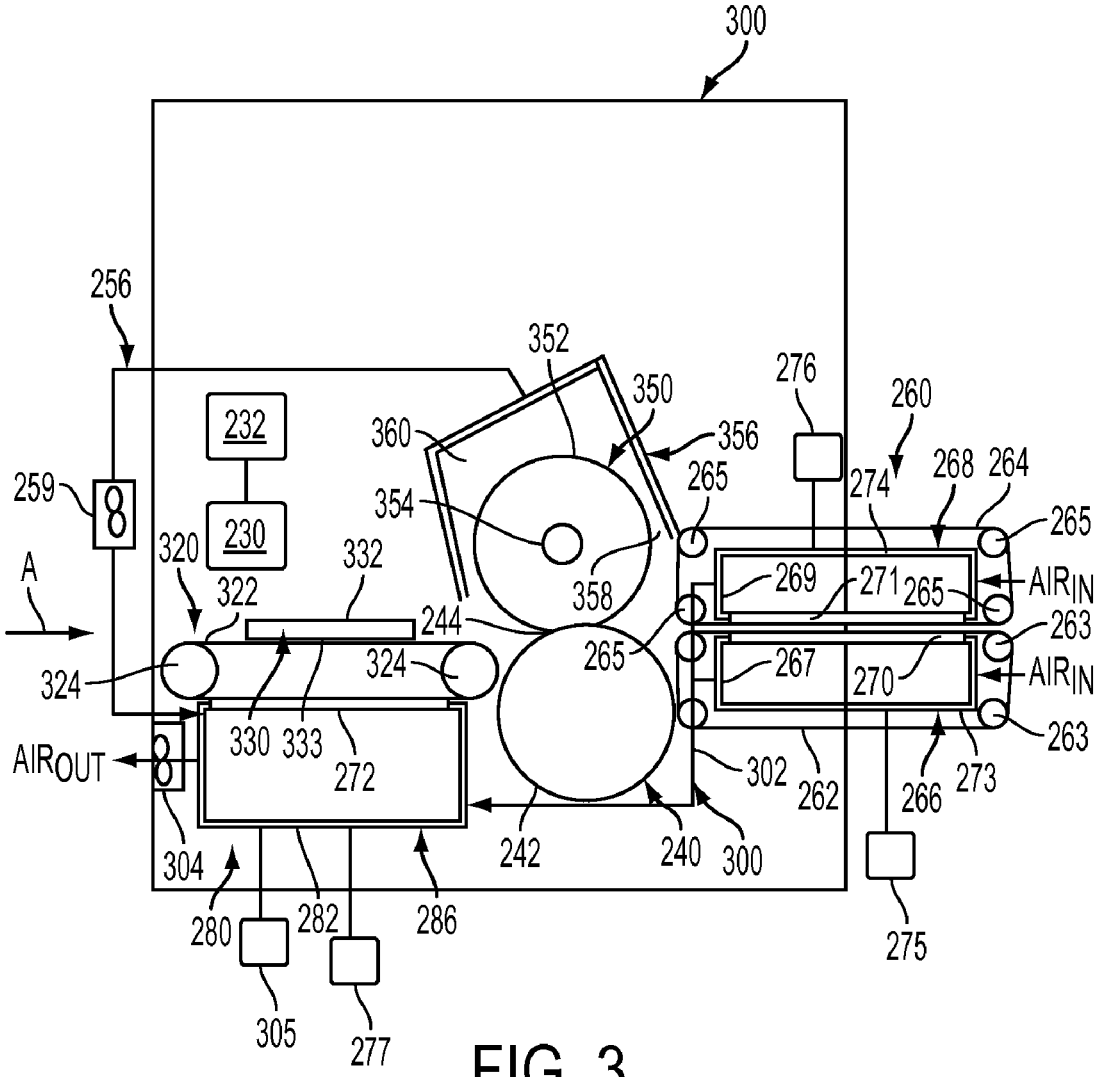
FIG. 3 illustrates an embodiment of a fixing device including opposed rolls and a substrate pre-heater.

FIG. 3 illustrates another exemplary embodiment of a fuser 300 constructed to fix marking materials onto substrates. As shown, the fuser 300 does not include a fuser belt. The fuser 300 includes a fuser roll 350 with an outer surface 352 and an internal heating element 354. The fuser roll 350 is surrounded substantially by a thermally-insulated enclosure 356 having an open end 358 and an interior space 360 in which heat emanated by the fuser roll 350 during operation of the fuser 300 is contained.

As shown in FIG. 3, the fuser 300 further includes a pressure roll 240, substrate cooler 260, heat transfer system 300, substrate pre-heater 280, heat transfer system 256, power supply 230 and controller 232. Each of these elements can have the same configuration as the same-numbered elements of the fuser 200 shown in FIG. 2, for example. The outer surface 352 of the fuser roll 350 is shown as being indented by contact with the pressure roll 240. In other embodiments, the outer surface 242 of the pressure roll 240 can be softer than the outer surface 352 of the fuser roll 350, resulting in the outer surface 242 being indented by contact with the fuser roll 350.

In other exemplary embodiments of the fuser 300 shown in FIG. 3, heat can transferred from the substrate cooler 260 to the substrate pre-heater 280 by a combination of convection and thermal conduction, or substantially only by thermal conduction, by providing a thermally-conductive member, such as a metallic member in thermal communication with the substrate cooler 260 and substrate pre-heater 280. For example, the thermally-conductive member can connect heat transfer members that contact opposite surfaces of substrates in the substrate cooler 260 to a heat transfer member that contacts the conveyer belt 322.

In other exemplary embodiments, heat transferred from substrates can be recycled in apparatuses in which phase-change inks are applied to a transfer surface of a heated drum, and the ink is applied to a pre-heated substrate. The pre-heated substrate is passed through a nip formed by the heated drum and a transfer roller to transfer ink to the substrate. At the nip, heat from the substrate and the drum heat the ink to cause it to adhere to the substrate. Exemplary apparatuses of this type are disclosed in U.S. Pat. No. 5,614,933, which is incorporated herein by reference in its entirety.

In such apparatuses, a substrate cooler, such as the substrate cooler 260, can be used to remove heat from substrates that have passed through the nip, and a substrate pre-heater, such as substrate pre-heater 280, can be used to pre-heat the subsequent substrates by applying heat recovered in the substrate cooler and transferred from the substrate cooler to the substrate pre-heater via a heat transfer system, such as the heat transfer system 300, prior to entering the nip and transferring ink to the substrates.

In other exemplary embodiments, heat transferred from substrates can be recycled in direct-to-paper phase change ink apparatuses, such as disclosed in U.S. patent application Ser. No. 12/197,492, which is incorporated herein by reference in its entirety. In such apparatuses, a substrate cooler, such as the substrate cooler 260, can be used to remove heat from substrates that have passed through a spreader including an image-side roll and a pressure roll forming a nip. In such apparatuses, rolls of the spreader apply heat and pressure to printable substrates, such as paper, to spread ink drops applied to the substrates. A substrate pre-heater, such as substrate pre-heater 280, can be installed to pre-heat the substrates using heat recovered in the substrate cooler and transferred to the substrate pre-heater via a heat transfer system, such as the heat transfer system 300, prior to entering the spreader.

Example

Thermal models were prepared to demonstrate heat recycling in a fixing device having a belt fuser configuration as shown in FIG. 2. Table 1 shows a thermal balance model for reclaiming heat from fused substrates in the fixing device. In the model, 120 gsm coated paper sheets conveyed at a process speed of 137 ppm and a speed of 0.585 m/s are used. A substrate cooler including first and second heat sinks is used. Each the first and second heat sinks has a width of 356 mm and includes 80 fins having a length of 500 mm, a height of 76 mm and a thickness of 2 mm. The fins extend parallel to each other and to the process direction of the fixing device and have a spacing perpendicular to the process direction of 2 mm. Each heat sink removes heat by conduction from one side of substrates passed through the substrate cooler.

Air is circulated through the first and second heat sinks opposite to, and parallel to, the process direction of the fixing device. The sheets exit the nip at a mean temperature of 96° C. and are cooled by the substrate cooler to a temperature of about 64° C. The cooling air is heated from ambient temperature (20° C.) to 91° C. in the substrate cooler by heat transferred from the paper to the air. The substrate cooler recovers 665 W of thermal energy from a series of the coated paper sheets passed through the substrate cooler at a rate of 137 pages per minute.

The heated air exits from the substrate cooler and is transported through a thermally-insulated flow passage to the substrate pre-heater positioned upstream from the nip. The pre-heater includes a single heat sink having a width of 356 mm with 100 fins. The fins have a length of 500 mm, a height of 400 mm and a thickness of 2 mm. The fins extend parallel to each other and to the process direction and have a spacing of 2 mm. The pre-heater heats the paper sheets from ambient temperature (20° C.) to about 51° C. The heated air is cooled down from 91° C. to 22° C. as a result of heating the paper sheets. The total amount of heat transferred back to the series of cold paper sheets at the substrate pre-heater is about 646 W.

TABLE 1

| Substrate Cooling | Air Properties | Substrate Cooler Fins | Substrate Pre-heater Fins | Substrate Pre-heating |
|---|---|---|---|---|
| $T_{fused}$: 96° C.<br>$T_{cool}$: 63.8° C.<br>$h_{cool}$: 1000 W/m$^2$k<br>Sides Cooled: 2<br>Dwell Time$_{cool}$: 0.85 s | Flow Rate: 0.008 m$^3$/s<br>Flow rate: 17 cfm<br>Density: 1.2 kg/m$^3$<br>m dot: 0.009356 kg/s<br>$T_{amb}$: 20° C. | $T_\infty$: 55.3° C.<br>$T_{cool}$: 63.8° C.<br>α: 10.0 W/m$^2$k<br>k: 200 W/mK<br>Height: 76 mm | Height: 400 mm | Sides Heated: 1<br>$T_{amb}$: 20° C.<br>$T_{heated}$: 51.2° C.<br>$Q_{substrates}$: 645.8 W<br>$T_{air\ in}$: 91° C. |
| Density: 1200 kg/m$^3$<br>Cp: 1250 J/kgK<br>Thickness: 100 μm<br>Width: 0.279 m<br>Length: 0.216 m<br>$P_{cooling}$: 665 W | $T_{out\ cooler}$: 20° C.<br>$T_{avg}$: 55.3° C.<br>$Q_{to\ air}$: 665 W | Width: 356 mm<br>Thickness: 2 mm<br>Length: 500 mm<br>Density: 154 mm<br>No.: 80<br>Gap: 2 mm<br>Area: 0.001 m$^2$<br>$Q_{heat\ sink}$: 323.3 W<br>$Q_{cooler}$: 665 W | Width: 356 mm<br>Thickness: 2 mm<br>Length: 500 mm<br>No.: 100<br>Gap: 2 mm | $T_{air\ out}$: 22° C.<br>$T_{air\ avg}$: 56° C.<br>$Q_{air}$: 645.8 W<br>$T_{heat\ sink}$: 51.2° C.<br>R: 0.008° C./W<br>$Q_{pre\text{-}heater}$: 645.8 W |

Table 2 shows the amount of power that the fuser uses when substrates are pre-heated to temperatures 37.5° C., 51° C. and 55° C.

TABLE 2

| $T_{substrate}$ [° C.] | $T_{fuser}$ [° C.] | $T_{cavity}$ [° C.] | Fuser Power [W] | Additional Power Consumption | Power Loss [W] |
|---|---|---|---|---|---|
| 20 | 183 | 120 | 2934 | 0 | 932 |
| 37.5 | 174 | 120 | 2685 | 120 | 778 |
| 51 | 168 | 120 | 2143 | 120 | 655 |
| 55 | 166 | 120 | 1983 | 120 | 619 |

By pre-heating substrates, the fuser fuses marking material using less power. As shown in Table 2, the fuser power is decreased by increasing the substrate pre-heating temperature. There is an estimated additional power consumption of about 120 W for the air blower and substrate cooler and substrate pre-heater belt drives. Pre-heating substrates to a temperature of 51° C. provides a total power savings of about 655 W (27%).

It will be appreciated that various ones of the above-disclosed and other features and functions, or alternatives thereof, may be combined into many other different systems or applications. Various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:

a first member including a first surface;

a second member including a second surface forming a nip with the first surface;

a substrate cooler disposed downstream from the nip configured to receive a first substrate exiting the nip, the substrate cooler being configured to remove heat from the first substrate by conduction, the substrate cooler comprising:

a first heat sink comprising a first heat transfer member and a plurality of first heat transfer fins disposed interiorly of a first heat transfer belt, the first heat transfer fins being configured to extend in a direction parallel to a process direction, the first heat transfer belt being configured to contact the first heat transfer member and a first surface of the first substrate when the first substrate is received in the substrate cooler; and a second heat sink comprising a second heat transfer member and a plurality of second heat transfer fins disposed interiorly of a second heat transfer belt, the second heat transfer fins being configured to extend in a direction parallel to the process direction, the second heat transfer belt being configured to contact the second heat transfer member and an opposite second surface of the first substrate when the first substrate is received in the substrate cooler;

a substrate pre-heater disposed upstream from the nip configured to apply heat to conductively pre-heat at least a second substrate as the second substrate is advanced by the substrate pre-heater before the second substrate enters the nip, the substrate pre-heater comprising:

a third heat sink comprising a third heat transfer member; and a conveyor including a conveyer belt configured to contact the third heat transfer member, the conveyer belt being configured to (1) convey the first substrate and subsequently the second substrate to the nip, and (2) be heated by the third heat transfer member to cause the conveyer belt to pre-heat at least the second substrate before the second substrate enters the nip;

a first heat transfer system configured to transfer heat from the substrate cooler to the substrate pre-heater;

a thermally-insulated enclosure surrounding at least a portion of the first member; and a second heat transfer system configured to transfer heat from inside of the enclosure to the substrate pre-heater, wherein the substrate pre-heater is configured to use the heat transferred from both the first heat transfer system and the second heat transfer system to pre-heat at least the second substrate before the second substrate enters the nip.

2. The apparatus of claim 1, wherein:

the first member comprises a first roll including the first surface and a heating element configured to heat the first surface; and the second member comprises a second roll including the second surface.

3. The apparatus of claim 1, wherein:

the first member comprises a belt including the first surface;

a first roll supports the belt and comprises a heating element configured to heat the first surface; and the second member comprises a second roll including the second surface.

4. The apparatus of claim 1, wherein the first heat transfer system comprises:

a thermally-insulated first flow passage in fluid communication with the substrate cooler and the substrate pre-heater; and a first blower configured to draw air into and through the substrate cooler, through the first flow passage and into the substrate pre-heater, the air being heated in the substrate cooler by heat removed from the first substrate, wherein the heated air heats the substrate pre-heater to a temperature above ambient temperature.

5. The apparatus of claim 4, wherein the second heat transfer system comprises:

a thermally-insulated second flow passage in fluid communication with the enclosure and the substrate pre-heater; and a second blower configured to circulate hot air from inside of the enclosure to the substrate pre-heater through the second flow passage.

6. The apparatus of claim 1, further comprising a marking device disposed upstream of the nip configured to apply marking material to the first substrate and subsequently the second substrate.

7. The apparatus of claim 1, wherein the third heat sink is larger than at least one of the first heat sink and the second heat sink.

8. A fixing device, comprising:

a first member including a first surface;

a second member including a second surface forming a nip with the first surface;

a substrate cooler disposed downstream from the nip configured to receive a first substrate exiting the nip, the substrate cooler being configured to remove heat from the first substrate by conduction, the substrate cooler comprising:

a first heat sink comprising a first heat transfer member and a plurality of first heat transfer fins disposed interiorly of a first heat transfer belt, the first heat transfer fins being configured to extend in a direction parallel to a process direction, the first heat transfer belt being configured to contact the first heat transfer member and a first surface of the first substrate when the first substrate is received in the substrate cooler; and a second heat sink comprising a second heat transfer member and a plurality of second heat transfer fins disposed interiorly of a second heat transfer belt, the second heat transfer fins being configured to extend in a direction parallel to the process direction, the second heat transfer belt being configured to contact the second heat transfer member and an opposite second surface of the first substrate when the first substrate is received in the substrate cooler;

a substrate pre-heater disposed upstream from the nip configured to apply heat to conductively pre-heat at least a second substrate as the second substrate is advanced by the substrate pre-heater before the second substrate enters the nip, the substrate pre-heater comprising:

a third heat sink comprising a third heat transfer member; and a conveyor including a conveyer belt configured to contact the third heat transfer member, the conveyer belt being configured to (1) convey the first substrate and subsequently the second substrate to the nip, and (2) be heated by the third heat transfer member to cause the conveyer belt to pre-heat at least the second substrate before the second substrate enters the nip;

a first heat transfer system configured to transfer heat from the substrate cooler to the substrate pre-heater;

a thermally-insulated enclosure surrounding at least a portion of the first member; and a second heat transfer system configured to transfer heat from inside of the enclosure to the substrate pre-heater, wherein the substrate pre-heater is configured to use the heat transferred from both the first heat transfer system and the second heat transfer system to pre-heat at least the second substrate before the second substrate enters the nip.

9. The fixing device of claim 8, wherein:

the first member comprises a first roll including the first surface and a heating element configured to heat the first surface; and the second member comprises a second roll including the second surface.

10. The fixing device of claim 8, wherein:

the first member comprises a belt including the first surface;

a first roll supports the belt and comprises a heating element configured to heat the first surface; and the second member comprises a second roll including the second surface.

11. The fixing device of claim 8, wherein the first heat transfer system comprises:

a thermally-insulated first flow passage in fluid communication with the substrate cooler and the substrate pre-heater; and a first blower configured to draw air into and through the substrate cooler, through the first flow passage and into the substrate pre-heater, the air being heated in the substrate cooler by heat removed from the first substrate, wherein the heated air heats the substrate pre-heater to a temperature above ambient temperature.

12. The fixing device of claim 11, wherein the second heat transfer system comprises:

a thermally-insulated second flow passage in fluid communication with the enclosure and the substrate pre-heater; and a second blower configured to circulate hot air from inside of the enclosure to the substrate pre-heater through the second flow passage.

13. The apparatus of claim 8, wherein the third heat sink is larger than at least one of the first heat sink and the second heat sink.

14. A method of pre-heating substrates in an apparatus useful in printing comprising a first member including a first surface and a second member including a second surface forming a nip with the first surface, the method comprising:

removing heat from the first substrate by conduction in a substrate cooler disposed downstream from the nip, the substrate cooler being configured to receive a first substrate exiting the nip, the substrate cooler being configured to remove heat from the first substrate by conduction, the substrate cooler comprising:

a first heat sink comprising a first heat transfer member and a plurality of first heat transfer fins disposed interiorly of a first heat transfer belt, the first heat transfer fins being configured to extend in a direction parallel to a process direction, the first heat transfer belt being configured to contact the first heat transfer member and a first surface of the first substrate when the first substrate is received in the substrate cooler; and a second heat sink comprising a second heat transfer member and a plurality of second heat transfer fins disposed interiorly of a second heat transfer belt, the second heat transfer fins being configured to extend in a direction parallel to the process direction, the second heat transfer belt being configured to contact the second heat transfer member and an opposite second surface of the first substrate when the first substrate is received in the substrate cooler;

transferring heat from the substrate cooler by way of a first heat transfer system to a substrate pre-heater disposed upstream from the nip, the substrate pre-heater being configured to apply heat to conductively pre-heat at least a second substrate as the second substrate is advanced by the substrate pre-heater before the second substrate enters the nip, the substrate pre-heater comprising:

a third heat sink comprising a third heat transfer member; and a conveyor including a conveyer belt configured to contact the third heat transfer member, the conveyer belt being configured to (1) convey the first substrate and subsequently the second substrate to the nip, and (2) be heated by the third heat transfer member to cause the conveyer belt to pre-heat at least the second substrate before the second substrate enters the nip;

transferring heat by way of a second heat transfer system configured to transfer heat from inside a thermally-insulated enclosure surrounding at least a portion of the first member to the substrate pre-heater; and applying the heat transferred from both the first heat transfer system and the second heat transfer system to conductively pre-heat at least the second substrate at the substrate pre-heater before the second substrate enters the nip.

15. The method of claim 14, further comprising drawing air into and through the substrate cooler, through the first heat transfer system and into the substrate pre-heater, the air being heated in the substrate cooler by heat removed from substrates including the first substrate, wherein the heated air heats the substrate pre-heater to a temperature above ambient temperature.

16. The apparatus of claim 14 wherein the third heat sink is larger than at least one of the first heat sink and the second heat sink.

* * * * *